US009926754B2

(12) United States Patent
Pereyra et al.

(10) Patent No.: US 9,926,754 B2
(45) **Date of Patent: *Mar. 27, 2018**

(54) SUCKER ROD GUIDE

(71) Applicant: TENARIS CONNECTIONS B.V., Amsterdam (NL)

(72) Inventors: Matias Pereyra, San Luis (AR); Alejandro Levrino, Buenos Aires (AR); Bernardo Bouillard, San Luis (AR)

(73) Assignee: Tenaris Connections B.V. (NL)

( * ) Notice: Subject to any disclaimer, the term of this patent is extended or adjusted under 35 U.S.C. 154(b) by 469 days.

This patent is subject to a terminal disclaimer.

(21) Appl. No.: 14/681,818

(22) Filed: Apr. 8, 2015

(65) Prior Publication Data

US 2015/0252636 A1 Sep. 10, 2015

Related U.S. Application Data

(63) Continuation of application No. 13/280,444, filed on Oct. 25, 2011, now Pat. No. 9,010,418.

(51) Int. Cl.
*E21B 17/10* (2006.01)
*E21B 19/22* (2006.01)

(52) U.S. Cl.
CPC ..... *E21B 19/22* (2013.01); *E21B 17/1042* (2013.01); *E21B 17/1071* (2013.01)

(58) Field of Classification Search
CPC ..... E21B 17/1071; E21B 17/1042; E21B 17/1064; E21B 17/22; E21B 17/1057; E21B 17/1078; E21B 17/1007
See application file for complete search history.

(56) References Cited

U.S. PATENT DOCUMENTS

| | | | | |
|---|---|---|---|---|
| 2,153,787 A | | 4/1939 | Anderson | |
| 2,307,688 A | | 1/1943 | Larson | |
| 3,410,613 A | | 11/1968 | Kuus | |
| 3,963,075 A | | 6/1976 | Evans | |
| 4,088,185 A | * | 5/1978 | Carson | E21B 17/1071 15/104.16 |
| 4,099,564 A | * | 7/1978 | Hutchison | E21B 17/1078 166/241.1 |
| 4,275,935 A | | 6/1981 | Thompson et al. | |
| 4,809,777 A | * | 3/1989 | Sable | E21B 17/1071 166/241.2 |

(Continued)

OTHER PUBLICATIONS

New Era Rod Guides, R&M Energy Systems, Robbins Myers Fluid Management Group, 2010.
Norris Sidewinder Sucker Rod Guides, Norris, A Dover Company.

*Primary Examiner* — Daniel P Stephenson
(74) *Attorney, Agent, or Firm* — Fish & Richardson P.C.

(57) ABSTRACT

A polymeric rod guide for a sucker rod, said polymeric rod guide having a body surrounding and coaxial with the sucker rod and molded in fixed contact with the rod. The body having a polygonal cross-section and a plurality of blades longitudinally disposed and extending from the body, each blade having a pair of planar longitudinal side walls and an exterior longitudinal edge, each of said blades having a first blade face disposed between a first terminal end of the blade and the exterior longitudinal edge and a second blade face disposed between a second terminal end of the blade and the exterior longitudinal edge, and an area of the body between the longitudinal side wall of a first blade and the longitudinal side wall of an adjacent second blade defines a trough having a plurality of planar surfaces.

42 Claims, 3 Drawing Sheets

(56) References Cited

U.S. PATENT DOCUMENTS

| | | | | |
|---|---|---|---|---|
| 4,984,633 | A | 1/1991 | Langer et al. | |
| 5,115,863 | A | 5/1992 | Olinger | |
| 5,191,938 | A | 3/1993 | Sable et al. | |
| 5,247,990 | A | 9/1993 | Sudol et al. | |
| 5,358,041 | A | 10/1994 | O'Hair | |
| 5,487,426 | A | 1/1996 | O'Hair | |
| 5,492,174 | A | 2/1996 | O'Hair | |
| 5,692,562 | A | 12/1997 | Squires | |
| 5,908,072 | A | 6/1999 | Hawkins | |
| 5,937,948 | A | 8/1999 | Robbins, III | |
| 5,941,312 | A | 8/1999 | Vermeeren | |
| 6,016,866 | A | 1/2000 | Kaltwasser | |
| 6,152,223 | A | 11/2000 | Abdo et al. | |
| 6,182,754 | B1 | 2/2001 | Vermeeren | |
| 6,435,275 | B1 | 8/2002 | Kirk et al. | |
| 6,739,415 | B2 | 5/2004 | Mitchell et al. | |
| 7,159,668 | B2 | 1/2007 | Herrera | |
| 7,255,165 | B2 * | 8/2007 | Abdo | E21B 17/10 166/241.2 |
| 8,096,352 | B2 | 1/2012 | Ernst et al. | |
| D663,750 | S | 7/2012 | Andrigo et al. | |
| D676,464 | S | 2/2013 | Hansen et al. | |
| 8,511,377 | B2 | 8/2013 | Casassa et al. | |
| 9,010,418 | B2 * | 4/2015 | Pereyra | E21B 17/1042 166/241.4 |
| 2004/0011532 | A1 | 1/2004 | White | |
| 2008/0053653 | A1 | 3/2008 | Abdo | |
| 2012/0168149 | A1 | 7/2012 | Kaltwasser | |
| 2012/0193089 | A1 | 8/2012 | Makelki et al. | |
| 2012/0292021 | A1 | 11/2012 | Kaltwasser | |
| 2013/0098601 | A1 | 4/2013 | Pereyra et al. | |

* cited by examiner

SUCKER ROD GUIDE

CLAIM OF PRIORITY

This Application is a Continuation of and claims the benefit of priority to U.S. patent application Ser. No. 13/280,444, filed on Oct. 25, 2011 and entitled "Sucker Rod Guide", now U.S. Pat. No. 9,010,418, the contents of which are hereby incorporated by reference.

FIELD OF THE INVENTION

This disclosure relates generally to the field of guides for sucker rod strings and, more particularly, to a rod guide with a polygonal body and a plurality of blades.

BACKGROUND

Rod guides for centralizing sucker rods within production tubing are well known in the art. As shown in FIG. 1, a pumping unit 8 has attached thereto a polish rod 9. The polish rod 9 is attached longitudinally to a sucker rod 10 disposed inside of a tubing (T) which is disposed in a casing string (C). At the bottom end of the sucker rod 10 is a reciprocating pump (not shown). As the pumping unit moves the sucker rod 10 down, the barrel of the reciprocating pump fills with the production fluid to be produced. Conversely, as the pumping unit moves the sucker rod up, a valve in the reciprocating pump shuts and the production fluid in the pump barrel is lifted, displacing production fluid above it and forcing one pump-barrel's worth of production fluid out of the hole.

The sucker rod must extend from the pumping unit all the way down to the reciprocating pump, which may be several thousand feet below the surface. Consequently, the sucker rod is subjected to a variety of stresses: compression, tension, torsion, and bending. The rod is prevented from moving sideways or wobbling by the installation of periodic rod guides 12, 14 on the rod 10 thereby controlling rod and tubing wear. The rod guides typically have a number of vanes, fins or blades which extend radially and centralize the rod within the cylindrical tubing. This prevents the rod from wearing or from other damage. Any wear will, thus, occur to the rod guide fins.

The rod guides may be fabricated from various materials, such as synthetic materials which are oil-resistant and resistant to abrasion.

It is desirable to maximize the material available for wear to maximize the life of the rod guides. Thus, the cross-sectional area of the fins/blades/vanes may be maximized for maximum wear life.

Many prior art sucker rod guides (see U.S. Pat. Nos. 5,115,863; 5,358,041; and 6,152,223) include a body that is molded in intimate contact with the sucker rod. The body has simultaneously molded therewith a plurality of "fins", "blades" or "vanes" that extend radially from the body. Cross-sections of some prior art rod guides 12 and 14 are illustrated in FIGS. 1A and 1B.

SUMMARY

The present disclosure describes and illustrates a polymeric rod guide 26 for a sucker rod 10. The polymeric rod guide includes: a body 28 surrounding and coaxial with the sucker rod, said body having a polygonal cross-section molded in fixed contact with the sucker rod. The guide further includes a plurality of blades 30 longitudinally disposed and extending from the body 28, each blade having a pair of planar longitudinal side walls 40 and an exterior longitudinal edge 24, each of said blades having a first blade face 22 disposed between a first terminal end 23 of the blade and the exterior longitudinal edge 24 and a second blade face 22 disposed between a second terminal end 25 of the blade and the exterior longitudinal edge 24, and an area of the body between the longitudinal side wall 40 of a first blade and the longitudinal side wall 40 of an adjacent second blade defines a trough 32 having a plurality of planar surfaces 32*a*, 32*b*, 32*c*.

In some implementations the rod guide 26 further includes a first curved lead section 34 molded integral with the body 28. The lead section being disposed longitudinally about the rod and terminating at a first end on an outer surface of the rod and being disposed at a second end in integral contact with the body 28. The lead section having a curved surface 35 with a radius of curvature of between 20 and 22 mm. In some implementations, the first curved lead section 34 has an outer curved surface 35 that extends from the rod to the body. The curved surface defined by a tangent to the mid-point of the curved surface having an angle of between 5 and 20 degrees measured between a line parallel to the longitudinal axis of the rod and the tangent to the curved surface 35 of the lead section 34.

In the preferred embodiment, the rod guide 26 includes 4 blades circumferentially disposed 90 degrees about the guide body 28.

In some embodiments, the exterior longitudinal edge 24 of the rod guide 26 has a convex curved surface with a radius of curvature being a same radius of curvature as an inner surface of a tube (T) into which the rod and rod guide is to be used.

In the first embodiment, the trough 32 between the longitudinal side walls includes: a first planar surface 32*a* that tapers away from the first terminal end 23 of the blade face 22 at an angle (a1) measured between a line parallel to the longitudinal axis of the rod and the first planar surface (a), a second planar surface 32*b* disposed adjacent to the first planar surface (a), and a third planar surface 32*c* disposed adjacent to the second planar surface, said third planar surface tapers away from the second terminal end 25 of the blade face 22 at an angle (c1) measured between a line parallel to the longitudinal axis of the rod and the third planar surface 32*c*. The angle (a1) is generally less than or equal to 15 degrees, and the second planar surface is generally parallel to the axis of the rod, and the angle (c1) is less than or equal to 15 degrees. In the preferred embodiment, the angle (a1) is less than or equal to 4 degrees, the second planar surface is generally parallel to the axis of the rod, and the angle (c1) is less than or equal to 4 degrees.

In the first embodiment, the blade face 22 comprises a curved surface that extends from the first terminal end 23 of the blade to the exterior longitudinal edge 24, said curved surface defined by a tangent to the mid-point of the curved surface having an angle of in the range of 10 to 40 degrees measured between a line parallel to the longitudinal axis of the rod and the tangent to the curved surface of the blade face 22. The blade face 22 includes a curved surface that extends from the first terminal end 23 to the exterior longitudinal edge 24, said curved surface having a radius of curvature of in the range of 20 to 22 mm.

In the first embodiment, the second planar surface 32*b* has a first predetermined longitudinal length (Lb) parallel to the axis of the rod, the first planar surface 32*a* and the third planar surface 32*c* each have a longitudinal length (La, Lc) greater than the longitudinal length (Lb) of planar surface (b).

In some embodiments, the longitudinal length of the first planar surface 32*a* and third planar surface 32*c* is between 55 to 75 mm and the second planar surface 32*b* has a longitudinal length of between 0 and 30 mm.

In a preferred embodiment, the longitudinal length (Lb) of the second planar surface 32*b* can be at least twice a width of the second planar surface 32*b*.

In a second embodiment, a polymeric rod guide 126 for a sucker rod 110 includes a body 128 surrounding and coaxial with the sucker rod. The body has a polygonal cross-section molded in fixed contact with the sucker rod; a plurality of blades 130 longitudinally disposed and extending from the body 128; each blade having a pair of longitudinal side walls 140, each of said longitudinal side walls having a first planar surface 140*a* that tapers away from the first terminal end 123 of the blade face 122 at an angle (a') measured between a line parallel to the longitudinal axis of the rod and the first planar surface, a second planar surface 140*b* disposed adjacent to the first planar surface, and a third planar surface 140*c* disposed adjacent to the second planar surface, said third planar surface 140*c* tapering away from the second terminal end 125 of the blade face 122 at an angle (c') measured between a line parallel to the longitudinal axis of the rod and the third planar surface 140*c*. Each blade has an exterior longitudinal edge 124 and each of the blades has a first blade face 122 disposed between a first terminal end 123 of the blade and the exterior longitudinal edge 124, and a second blade face 122 disposed between a second terminal end 125 of the blade and the exterior longitudinal edge 124. The area of the body between the longitudinal side wall of a first blade and the longitudinal side wall of an adjacent second blade defines a trough 132 having a plurality of planar surfaces 132*a*, 132*b*, 132*c*.

In some embodiments, the angle (a') is less than 15 degrees, the second planar surface is generally perpendicular to the axis of the rod, and the angle (c') is less than 15 degrees.

In the preferred embodiment, the angle (a') is less than or equal to 4 degrees, the second planar surface is generally perpendicular to the axis of the rod, and the angle (c') is less than or equal to 4 degrees.

In the rod guide 126 the second planar surface 140*b* has a first predetermined longitudinal length (Lb') parallel to the axis of the rod, the first planar surface 140*a* and the third planar surface 140*c* each have a longitudinal length (La', Lc') greater than the longitudinal length (Lb') of planar surface 140*b*.

The longitudinal length of the first planar surface 140*a* and third planar surface 140*c* is between 55 to 75 mm and the second planar surface 140*b* has a longitudinal length of between 0 and 30 mm.

In a preferred embodiment, the longitudinal length (Lb') of the second planar section 140*b* is at least twice a width of the second planar section 140*b*.

The rod guide 126 further includes a first curved lead section 134 molded integral with the body 128. The lead section is disposed longitudinally about the rod and terminating at a first end on an outer surface of the rod and disposed at a second end in integral contact with the body 128. The lead section has a curved surface 135 with a radius of curvature of between 20 and 22 mm.

The curved surface defined by a tangent to the mid-point of the curved surface having an angle of between 5 and 20 degrees measured between a line parallel to the longitudinal axis of the rod and the tangent to the curved surface 135 of the lead section 34.

In the preferred embodiment, the rod guide 126 includes 4 blades circumferentially disposed 90 degrees about the guide body 128.

In some implementations, the exterior longitudinal edge 124 of the rod guide 126 has a convex curved surface with a radius of curvature being a same radius of curvature as an inner surface of a tube (T) into which the rod and rod guide is to be used.

In the second embodiment, the trough 132 between the longitudinal side walls includes: a first planar surface 132*a* that tapers away from the first terminal end 123 of the blade face 122 at an angle (a1) measured between a line parallel to the longitudinal axis of the rod and the first planar surface 132*a*, a second planar surface 132*b* disposed adjacent to the first planar surface 132*a*, a third planar surface 132*c* disposed adjacent to the second planar surface 132*b*, said third planar surface 132*c* tapers away from the second terminal end 125 of the blade face 122 at an angle (c1) measured between a line parallel to the longitudinal axis of the rod and the third planar surface 132*c*. The angle (a1) is less than or equal to 4 degrees, the second planar surface is generally parallel to the axis of the rod, and the angle (c1) is less than or equal to 4 degrees.

In the second implementation, the blade face 122 comprises a curved surface that extends from the first terminal end 123 of the blade to the exterior longitudinal edge 124. The curved surface defined by a tangent to the mid-point of the curved surface having an angle of in the range of 10 to 40 degrees measured between a line parallel to the longitudinal axis of the rod and the tangent to the curved surface of the blade face 122. The blade face 122 includes a curved surface that extends from the first terminal end 123 to the exterior longitudinal edge 124.

In the second implementation, the second planar surface 132*b* has a first predetermined longitudinal length (Lb) parallel to the axis of the rod, the first planar surface 132*a* and the third planar surface 132*c* each have a longitudinal length (La, Lc) greater than the longitudinal length (Lb) of planar surface 132*b*. The longitudinal length of the first planar surface 132*a* and third planar surface 132*c* is in the range of 55 to 75 mm and the second planar surface 132*b* has a longitudinal length of in the range of 0 to 30 mm. In a preferred embodiment, the longitudinal length (Lb) of the second planar surface 132*b* is at least twice a width of the second planar surface 132*b*.

The rod guide 26 may be installed in a sucker rod in a method comprising: molding a unitary rod guide coaxial about and in fixed contact with the sucker rod, said guide comprising a body portion 28 surrounding and coaxial with the sucker rod, said body having a plurality of blades 30 longitudinally disposed and extending from the body 28, each blade having a pair of planar longitudinal side walls 40 and an exterior longitudinal edge 24, each of said blades having a first blade face 22 disposed between a first terminal end 23 of the blade and the exterior longitudinal edge 24 and a second blade face 22 disposed between a second terminal end 25 of the blade and the exterior longitudinal edge 24, and an area of the body between the longitudinal side wall 40 of a first blade and the longitudinal side wall 40 of an adjacent second blade defines a trough 32 having a plurality of planar surfaces 32*a*, 32*b*, 32*c*.

The method may further include concurrently molding a first lead section 34 integral with the body 28, said lead section disposed longitudinally about the rod and terminating at a first end on an outer surface of the rod and disposed at a second end in contact with the body 28, said lead section having a curved surface 35 with a radius of curvature of between 20 and 22 mm and said curved surface further defined by a tangent to the mid-point of the curved surface having an angle of between 5 and 20 degrees measured between a line parallel to the longitudinal axis of the rod and the tangent to the curved surface 35 of the lead section 34.

The method may further include preparing a section of the rod 10 by placing an epoxy based glue on a predetermined portion of the rod 10 and placing particles having a diameter in the range of 0.71 to 1.18 mm onto the epoxy glue; and direct injection molding the rod guide 26, 126 about at least a portion of the prepared section of the rod.

The rod guide 126 may be installed on a sucker rod in a method comprising: molding a unitary rod guide coaxial about and in fixed contact with the sucker rod, said guide comprising a body portion 28 surrounding and coaxial with the sucker rod, said body having a plurality of blades 30 longitudinally disposed and extending from the body 28, each blade having a pair of longitudinal side walls 140, each of said longitudinal side walls having a first planar surface 140*a* that tapers away from the first terminal end 123 of the blade face 122 at an angle (a') measured between a line parallel to the longitudinal axis of the rod and the first planar surface, a second planar surface 140*b* disposed adjacent to the first planar surface, and a third planar surface 140*c* disposed adjacent to the second planar surface, said third planar surface 140*c* tapers away from the second terminal end 125 of the blade face 122 at an angle (c') measured between a line parallel to the longitudinal axis of the rod and the third planar surface 140*c*, each blade having an exterior longitudinal edge 124, each of said blades having a first blade face 122 disposed between a first terminal end 123 of the blade and the exterior longitudinal edge 124, and a second blade face 122 disposed between a second terminal end 125 of the blade and the exterior longitudinal edge 124, and an area of the body between the longitudinal side wall of a first blade and the longitudinal side wall of an adjacent second blade defines a trough 132 having a plurality of planar surfaces 132*a*, 132*b*, 132*c*.

The method of may further include concurrently molding a first curved lead section 34 integral with the body 28, said lead section disposed longitudinally about the rod and terminating at a first end on an outer surface of the rod and disposed at a second end in contact with the body 28, said lead section having a curved surface 35 with a radius of curvature of between 20 and 22 mm and said curved surface further defined by a tangent to the mid-point of the curved surface having an angle of between 5 and 20 degrees measured between a line parallel to the longitudinal axis of the rod and the tangent to the curved surface 35 of the lead section 34.

The method may further include: preparing a section of the rod 10 by placing an epoxy based glue on a predetermined portion of the rod 10 and placing particles having a diameter between 0.71 and 1.18 mm onto the epoxy glue; and direct injection molding the rod guide 26, 126 about at least a portion of the prepared section of the rod.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
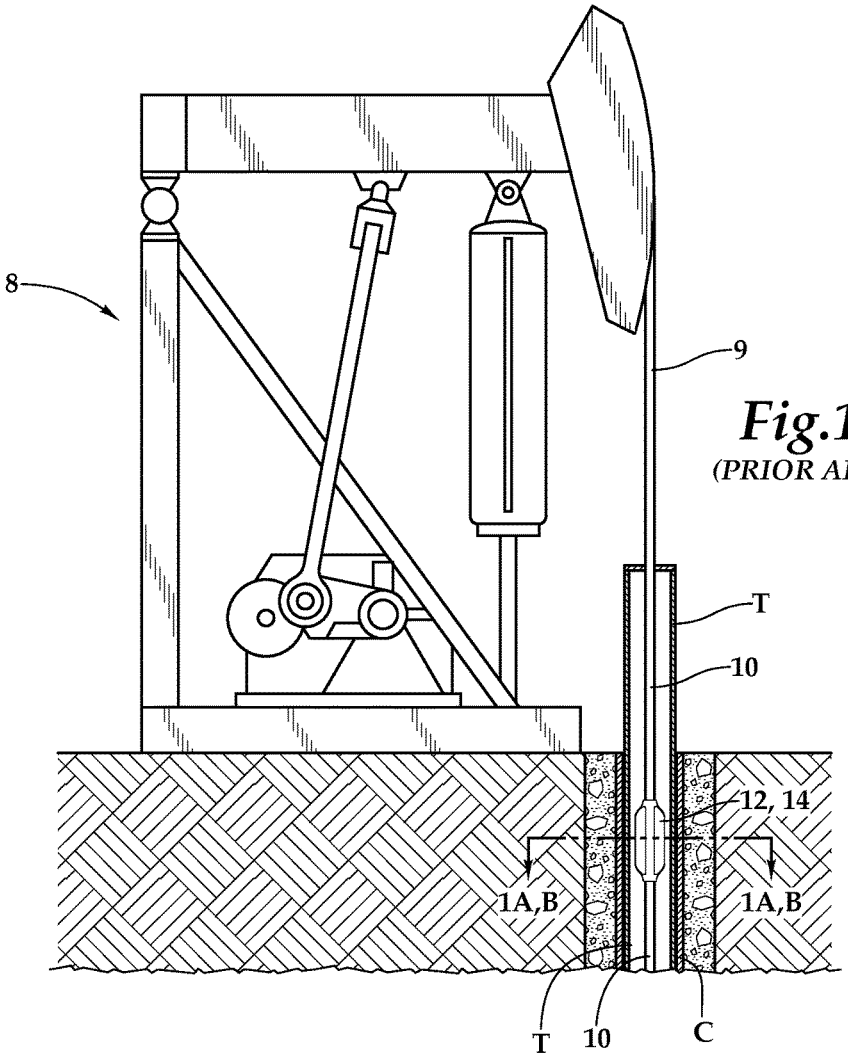
Fig.1 (PRIOR ART)
FIG. 1 is prior art pumping system illustrating a prior art rod guide disposed inside a tubing string.

As used herein, the term "blade" refers to the molded portion of the rod guide that extends from the body and may guidingly contact the interior surface of production tubing.

Referring now to FIGS. 2, 2A, 2B, 3, 4 and 4A wherein is illustrated a first embodiment of sucker rod guide 26 of the present disclosure. The polymeric rod guide 26 includes a body 28 surrounding and coaxial with the sucker rod. The body includes a polygonal cross-section molded in fixed contact with the sucker rod.

A plurality of blades 30 are longitudinally disposed and extend from the body 28, each blade having a pair of planar longitudinal side walls 40 and an exterior longitudinal edge 24. Each of said blades has a first blade face 22 disposed between a first terminal end 23 of the blade and the exterior longitudinal edge 24 and a second blade face 22 disposed between a second terminal end 25 of the blade and the exterior longitudinal edge 24. An area of the body between the longitudinal side wall 40 of a first blade and the longitudinal side wall 40 of an adjacent second blade defines a trough 32 having a plurality of planar surfaces 32*a*, 32*b*, 32*c*.

The rod guide 26 further includes first generally curved lead section 34 molded integral with the body 28. The lead section is disposed longitudinally about the rod and terminating at a first end on an outer surface of the rod and at a second end at each of the first terminal ends 23, 25 of each blade and at a terminal end of each trough 32 between each blade 30. The lead section 34 has an outer surface 35 that extends from the rod to the body 28. The outer curved surface 35 has a small radius of curvature of between 20 and 22 mm. The taper of the curved surface 35 is defined by a tangent to the mid point of the curve having an angle of between 5 and 20 as measured between the tangent and a line parallel to the longitudinal axis of the rod and the curved surface of the lead section 34. In the preferred embodiment the angle of the tangent is 15 degrees.

In some embodiments the rod guide 26 includes four blades 30 circumferentially disposed 90 degrees about the guide body 28.

In some embodiments the exterior longitudinal edge 24 of the rod guide 26 has a convex curved surface with a radius of curvature being a same radius of curvature as an inner surface of a tube (T) into which the rod and rod guide is to be used.

Figure 2:
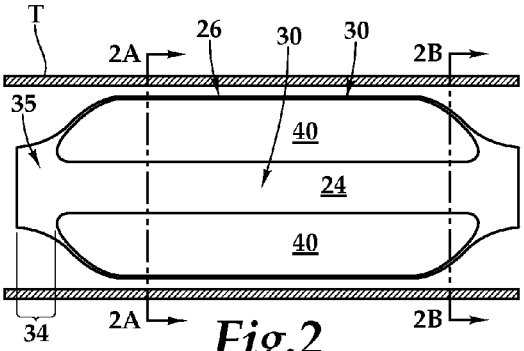
FIG. 2 is a side view of a first embodiment of a rod guide of the present disclosure illustrated inside a cross-section of tubing.
Figure 2A:
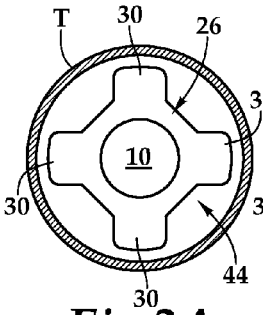
FIG. 2A is a transverse cross-section of the rod guide of FIG. 2 taken at section AA.
Figure 2B:
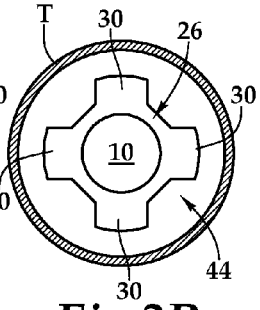
FIG. 2B is a transverse cross-section of the rod guide of FIG. 2 taken at section BB.
Figure 3:
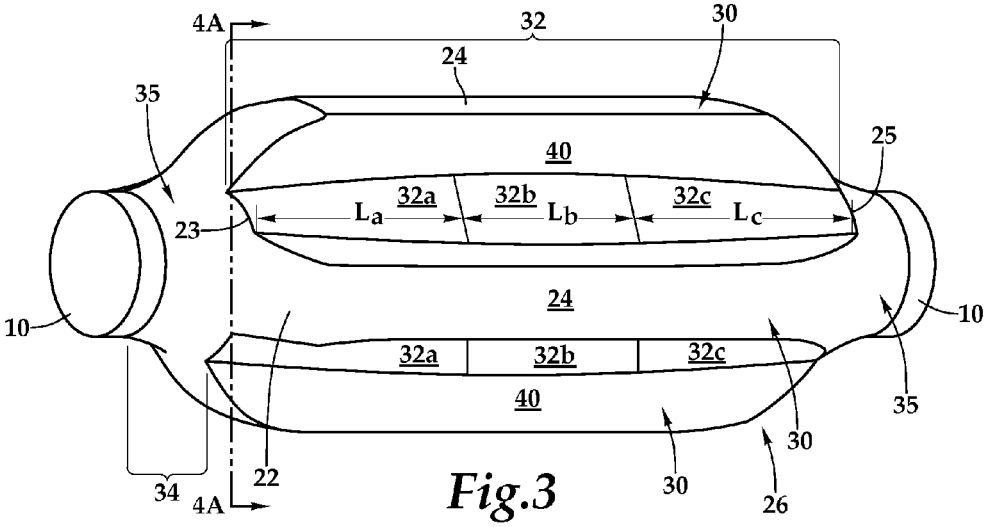
FIG. 3 is a perspective view of the rod guide of FIG. 2.
Figure 4:
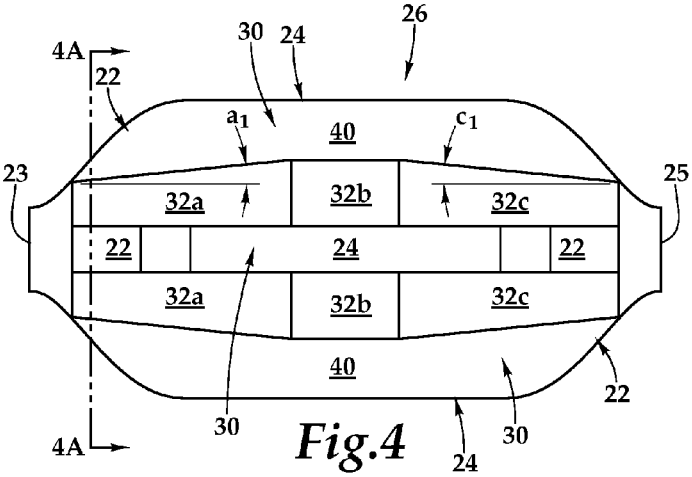
FIG. 4 is a partial side view of the rod guide of FIG. 2 partially rotated forward to illustrate planar surfaces 32*a*, 32*b* and 32*c* of blade 30.
Figure 4A:
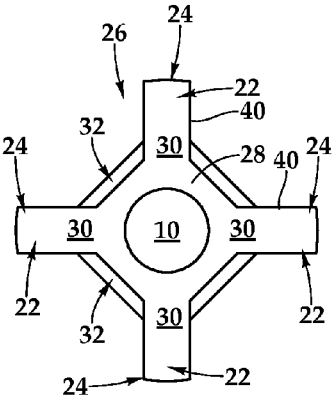
FIG. 4A is a transverse section view illustrating the trough 32 between the blades 30 of the rod guide of FIG. 4.

As illustrated in particular in FIGS. 3, 4 and 4A, the trough 32 between the longitudinal side walls 40 includes: a first planar surface 32*a* that tapers away from the first terminal end 23 of the blade face 22 at an angle (a1) measured between a line parallel to the longitudinal axis of the rod and the first planar surface 32*a*, a second planar surface 32*b* disposed adjacent to the first planar surface 32*a*, and a third planar surface 32*c* disposed adjacent to the second planar surface, said third planar surface tapers away from the second terminal end 25 of the blade face 22 at an angle (c1) measured between a line parallel to the longitudinal axis of the rod and the third planar surface 32*c*. In some embodiments the angle (a1) is less than 15 degrees, the second planar surface is generally parallel to the axis of the rod, and the angle (c1) is less than 15 degrees. In a preferred embodiment the angle (a1) is less than or equal to 4 degrees, the second planar surface is generally parallel to the axis of the rod, and the angle (c1) is less than or equal to 4 degrees. In a preferred embodiment angle (a1)=angle (c1). In general the trough 32 includes three sections: Section (a): having an increasing taper (from the guide end to the center of the guide); Section (b): having a substantially cylindrical configuration; and Section (c): having a decreasing taper (from the center of the guide to the end of the guide). As illustrated in FIGS. 2, 2A and 2B the cross-section area 44 of the cavity for fluid passage formed between blades and tubing (T) is higher at the beginning of the sucker rod guide than in the middle of, and so providing a desired nozzle effect that will be explained hereinafter in the discussion of the advantages of the present design.

Referring again to FIGS. 3, 4 and 4A, in some embodiments the blade face 22 comprises a curved surface having a small radius of curvature in the range of 20 to 22 mm. The taper of the surface is defined by a tangent to the curved surface taken in the midpoint of the curve. The angle of the tangent is between 10 and 40 degrees as measured between a line parallel to the longitudinal axis of the rod and the tangent to the curved surface of the blade face 22. In a preferred embodiment, the blade face 22 comprises a curved surface having a small radius of curvature in the range of 20 to 22 mm. The taper of the surface is defined by a tangent to the curved surface taken in the midpoint of the curve. The angle of the tangent is 32 degrees or less as measured between a line parallel to the longitudinal axis of the rod and the tangent to the curved surface of the blade face 22. In some embodiments there can be a planar surface between blade face 22 and the surface 35 of the lead section 34, but generally the cured surfaces join each other tangentially as illustrated in FIGS. 2, 3 and 4.

The second planar surface 32*b* of the rod guide 26 has a first predetermined longitudinal length (Lb) parallel to the axis of the rod, the first planar surface 32*a* and the third planar surface 32*c* each have a longitudinal length (La, Lc) greater than the longitudinal length (Lb) of planar surface 32*b*. In some embodiments the longitudinal length of the first planar surface 32*a* and third planar surface 32*c* is between 55 to 75 mm (preferably 65 mm) and the second planar surface 32*b* has a longitudinal length of between 0 and 30 mm. In a preferred embodiment, to stabilize the fluid the longitudinal length (Lb) of the second planar surface 32*b* is at least twice a width of the second planar surface (32*b*).

Referring now to FIGS. 5, 5A, 5B, 6, 7, 7A wherein is illustrated a second embodiment of sucker rod guide 126 of the present disclosure. The polymeric rod guide 126 for a sucker rod 110 includes a body 128 surrounding and coaxial with the sucker rod. The body has a polygonal cross-section molded in fixed contact with the sucker rod.

Unlike the first embodiment, in this second embodiment the lateral surfaces 140 of each blade 130 are also formed by tapered surfaces, 140*a*, 140*b* and 140 *c*. In this second embodiment, the rod guide 126 includes a plurality of blades 130 longitudinally disposed and extending from the body 128. Each blade having a pair of longitudinal side walls 140, each of said longitudinal side walls have a first planar surface 140*a* that tapers away from the first terminal end 123 of the blade face 122 at an angle (a') measured between a line parallel to the longitudinal axis of the rod and the first planar surface, a second planar surface 140*b* disposed adjacent to the first planar surface, and a third planar surface 140*c* disposed adjacent to the second planar surface, said third planar surface 140*c* tapers away from the second terminal end 125 of the blade face 122 at an angle (c') measured between a line parallel to the longitudinal axis of the rod and the third planar surface 140*c*. Each blade has an exterior longitudinal edge 124. Each blade has a first blade face 122 disposed between a first terminal end 123 of the blade and the exterior longitudinal edge 124, and a second blade face 122 disposed between a second terminal end 125 of the blade and the exterior longitudinal edge 124.

In some embodiments the angle (a') is less than 15 degrees, the second planar surface is generally perpendicular to the axis of the rod, and the angle (c') is less than 15 degrees. In a preferred embodiment the angle (a') is less than or equal to 4 degrees, the second planar surface is generally perpendicular to the axis of the rod, and the angle (c') is less than or equal to 4 degrees. In general the lateral face 140 includes three sections: Section (a): having an increasing taper (from the guide end to the center of the guide); Section (b): having a substantially cylindrical configuration; and Section (c): having a decreasing taper (from the center of the guide to the end of the guide).

The second planar surface 140*b* has a first predetermined longitudinal length (Lb') parallel to the axis of the rod, the first planar surface 140*a* and the third planar surface 140*c* each have a longitudinal length (La', Lc') greater than the longitudinal length (Lb') of planar surface (b). In some embodiments the longitudinal length of the first planar surface 140*a* and third planar surface 140*c* is between 55 to 75 mm (preferably 65 mm) and the second planar surface 140*b* has a longitudinal length of between 0 and 30 mm. In a preferred embodiment the longitudinal length (Lb') of the second planar section 140*b* is at least twice a width of the second planar section 140*b* to stabilize the fluid.

Figure 5:
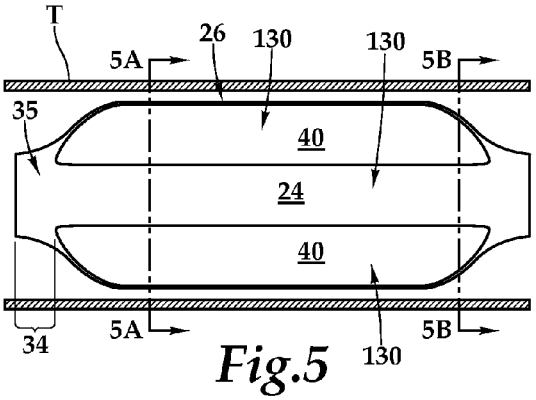
FIG. 5 is a side view of a second embodiment of a rod guide of the present disclosure illustrated inside a cross-section of tubing.
Figure 5A:
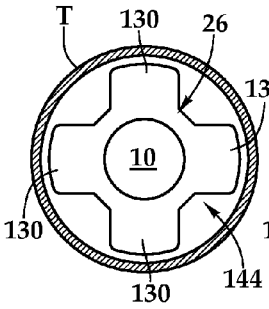
FIG. 5A is a transverse cross-section of the rod guide of FIG. 5 taken at section AA.
Figure 5B:
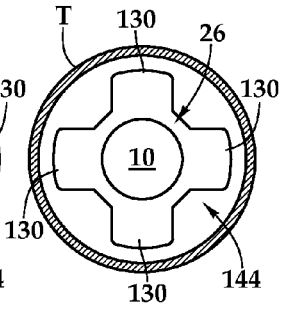
FIG. 5B is a transverse cross-section of the rod guide of FIG. 5 taken at section BB.

As illustrated in FIGS. 5, 5A and 5B the cross-section area 144 of the cavity for fluid passage formed between blades and tubing (T) is higher at the beginning of the sucker rod guide than in the middle of it, and so providing the desire nozzle effect that will be explained in the following section.

The guide further includes a first generally curved lead section 134 molded integral with the body 128. The lead section 134 is disposed longitudinally about the rod and terminating at a first end on an outer surface of the rod and at a second end at the body 128. The lead section 134 has a generally outer curved surface 135 that extends from the rod to the body 28. The outer surface 135 has a small radius of curvature of between 20 and 22 mm. The taper of the curved surface 135 is defined by a tangent to the mid point of the curve having an angle of between 5 and 20 as measured between the tangent and a line parallel to the longitudinal axis of the rod and the curved surface of the lead section 34. In the preferred embodiment the angle of the tangent is 15 degrees.

In a preferred embodiment the plurality of blades 130 includes 4 blades circumferentially disposed 90 degrees about the guide body 128. In some embodiments the exterior longitudinal edge 124 has a convex curved surface with a radius of curvature being a same radius of curvature as an inner surface of a tube (T) into which the rod and rod guide is to be used.

Similar to the first embodiment, in this second embodiment an area of the body 128 between the longitudinal side wall 140 of a first blade and the longitudinal side wall of an adjacent second blade defines a trough 132 having a plurality of planar surfaces 132*a*, 132*b*, 132*c*. In a preferred embodiment the trough 132 between the longitudinal side walls includes: a first planar surface 132*a* that tapers away from the first terminal end 123 of the blade face 122 at an angle (a1) measured between a line parallel to the longitudinal axis of the rod and the first planar surface 132*a*, a second planar surface 132*b* disposed adjacent to the first planar surface 132*a*, a third planar surface 132*c* disposed adjacent to the second planar surface 132*b*, said third planar surface 132*c* tapers away from the second terminal end 125 of the blade face 122 at an angle (c1) measured between a line parallel to the longitudinal axis of the rod and the third planar surface 132*c*. The angle (a1) is less than or equal to 4 degrees, the second planar surface is generally parallel to the axis of the rod, and the angle (c1) is less than or equal to 4 degrees. In a preferred embodiment angle (a1)=angle (c1). In general the trough 132 includes three sections: Section (a): having an increasing taper (from the guide end to the center of the guide; Section (b): having a substantially cylindrical configuration; and Section (c): having a decreasing taper (from the center of the guide to the end of the guide). As illustrated in FIGS. 5, 5A and 5B the cross-section area 144 of the cavity for fluid passage formed between blades and tubing (T) is higher at the beginning of the sucker rod guide than in the middle of it, and so providing the desired nozzle effect that will be explained hereinafter in the discussion of the advantages of the present design.

Figure 6:
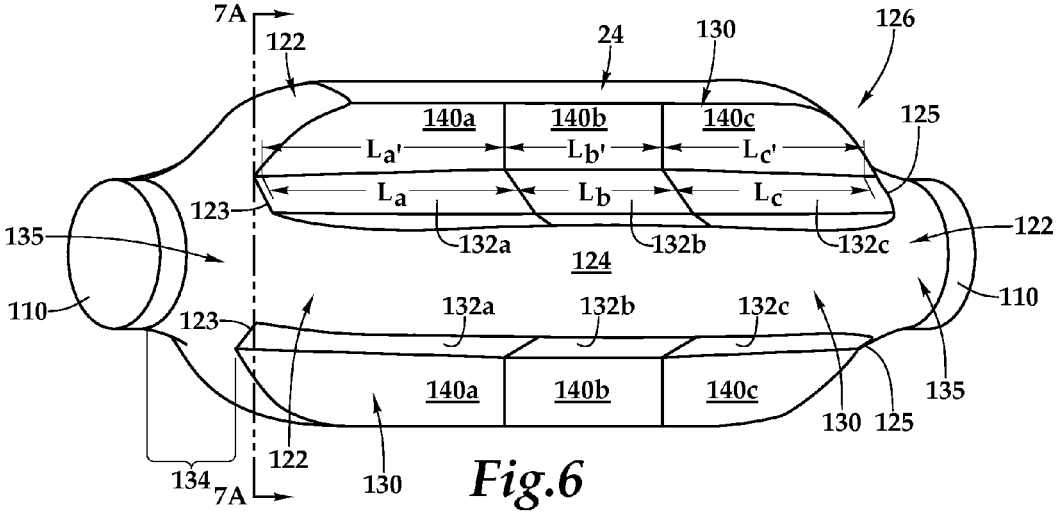
FIG. 6 is a perspective view of the rod guide of FIG. 5.
Figure 7:
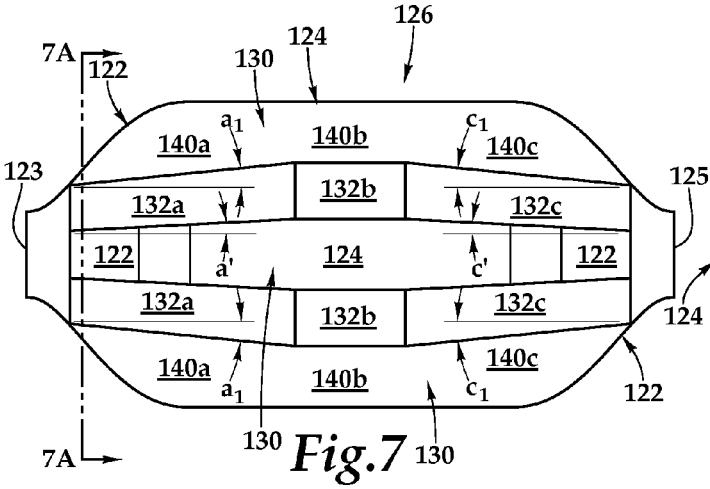
FIG. 7 is a partial side view of the rod guide of FIG. 5 partially rotated forward to illustrate planar surfaces 132*a*, 132*b* and 132*c* and 140*a*, 140*b* and 140*c* of blade 30.
Figure 7A:
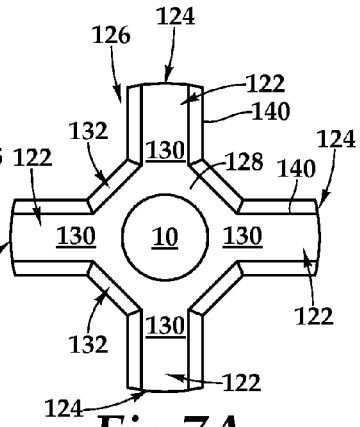
FIG. 7A is a transverse section view illustrating the trough 132 between the blades 130 of the rod guide of FIG. 7.

Referring again to FIGS. 6, 7 and 7A, in some embodiments the blade face 122 has a curved surface with a small radius of curvature in the range of 20 to 22 mm. The taper of the surface is defined by a tangent to the curved surface taken in the midpoint of the curve. The angle of the tangent is between 10 and 40 degrees as measured between a line parallel to the longitudinal axis of the rod and the tangent to the curved surface of the blade face 122. In a preferred embodiment, the blade face 122 comprises a curved surface having a small radius of curvature in the range of 20 to 22 mm. The taper of the surface is defined by a tangent to the curved surface taken in the midpoint of the curve. The angle of the tangent is 32 degrees or less as measured between a line parallel to the longitudinal axis of the rod and the tangent to the curved surface of the blade face 122. In some embodiments there can be a planar surface between blade face 122 and the surface 135 of the lead section 134, but generally the curved surfaces join each other tangentially as illustrated in FIGS. 5, 6 and 7.

The second planar surface (b) has a first predetermined longitudinal length (Lb) parallel to the axis of the rod, the first planar surface (a) and the third planar surface (c) each have a longitudinal length (La, Lc) greater than the longitudinal length (Lb) of planar surface (b). In some embodiments, the longitudinal length of the first planar surface (a) and third planar surface (c) is between 55 to 75 mm (preferably 65 mm) and the second planar surface (b) has a longitudinal length of between 0 and 30 mm. In a preferred embodiment to stabilize the fluid, the longitudinal length (Lb) of the second planar section 132*b* is at least twice a width of the second planar section 132*b*.

The unitary rod guide 26, 126 of the present disclosure is molded coaxial about and in fixed contact with the sucker rod 10. The lead section 34, 134 is unitary with and molded concurrently with the body 28, 128.

It is known in the art that when plastic rod guides 12, 14 are molded directly onto the rod, that the contraction effect of the solidifying polymeric material over the steel rod body provides an adherence force. In deviated wellbores, the adherence force provided by the contraction of the polymeric material on the rod may be insufficient to prevent the rod guide from de-boding with the rod. It has been found that the breakaway force necessary to dislodge the polymeric rod guide may be enhanced by increasing the interference between the polymeric rod guide 26, 126 and the rod 10. It has been found that the interference may be enhanced by increasing the friction coefficient between the rod 10 and the rod guide 26, 126. In one embodiment, epoxy based glue (stable to 150 degrees C.) may be placed on the rod 10 and particles having a diameter of between 0.71 and 1.18 mm (preferably 0.8 mm) (sand or synthetic spheres) placed onto the epoxy glue along each section of the rod before the polymeric rod guide 26, 126 is direct injection molded thereon. In some embodiments it has been found that if a 120 mm section of the rod is prepared as heretofore described, the breakaway force provided by the enhanced friction coefficient may be equivalent to the force obtained with direct injection over a rod that has not had such surface preparation.

Some Advantages of the Rod Guide of the Present Disclosure

Figure 1A:
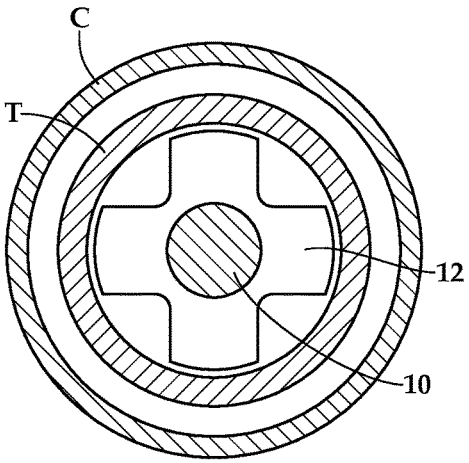
Fig.1A (PRIOR ART)
FIG. 1A is a transverse cross-section of a prior art rod guide.
Figure 1B:
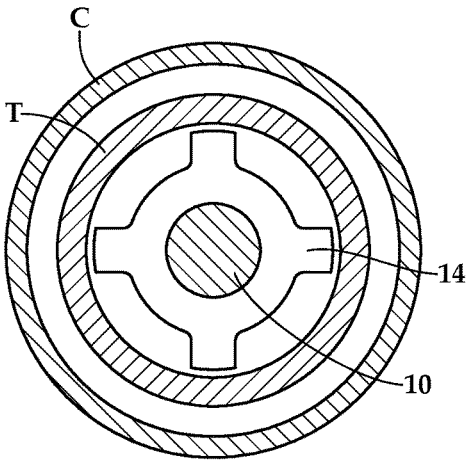
Fig.1B (PRIOR ART)
FIG. 1B is a transverse cross-section of a prior art rod guide.

Prior art designs of FIGS. 1A and 1B illustrate transition zones of concave or convex surfaces between blades of rod guides 12. In the illustrated prior art rod guides 12, 14 these transition zones have constant a cross-section along the body portion of the rod guide. In the prior art constant cross-section geometry, if it is assumed that there is zero friction conditions (between the walls of rod guide and the produced fluid), that the produced fluid will move at a constant speed along the passage through the tunnel defined by the rod guide inside of the tubing.

When considering the effect of friction between the wall of the rod guide and the produced fluid, the speed profile begins from 0 to an average value in the center of the rod guide. This effect defines what may be referred to as "the boundary layer". As the flow velocity decreases, it results in a decrease in the Reynolds number, which results in generating a boundary layer having a lower energization level and therefore more prone to detachment from the surface of the rod guide and tubing. Detachment of the boundary layer produces turbulent areas causing greater inefficient movement of fluid and an increase of pressure drop.

The design of the present disclosure includes a variable fluid passage 44 and 144 (a nozzle like configuration) having decreasing cross-sections (from the beginning towards the larger middle section 32*b*, 132*b* of the rod guide 26, 126 (see FIGS. 2A, 2B, 3, 5A, 5B and 6). This geometry produces, due to the fact that the flow remains constant, an increase in the average speed (velocity) in the center of the section, that also increases the Reynolds number, and so, the boundary layer results in an increasing speed profile and higher levels of energization, this effect favors to keep the boundary layer adhered to the wall of the rod guide 26 and 126, and so, there are no turbulent zones increasing the pressure drop in the rod guide.

The end section 32*a*, 132*a* is a stabilization zone, directed to stabilize the speed profile of the fluid, in order to maximize efficiency of the guide. This stabilization zone is needed for a smooth change in the speed profile prior to entering into mid-zone in order to maintain the boundary layer attached to the surface of the rod guide 26, 126.

The end sections 32*c*, 132*c* area having a decreasing section allows fluid to slow down and reach the same condition as prior to entering into the flow path 44, 144 of the rod guide. The rod guide 26, 126 has a better efficiency regarding the fluid flow and regarding the general pumping system.

Additionally, with regard to embodiment 2, it is worth noting that the tapered surfaces 140*a*, 140*b* and 140*c* are designed to enhance the overall efficiency of the guide due to the "venturi" effect that takes place when the fluid passes through the fluid passage 144 formed between the production tubing (T), and longitudinally tapered surfaces 140*a*, 140*b* and 140*c*. In this embodiment, the lateral walls 140 of blades 130 become wider towards the center of the rod guide. For example referring to FIGS. 5, 5A and 5B, the width of the blade 130 is larger in sections 132*b* and 140*b* than the width in sections 132*a* and 140*a*, due to the nozzle-like form of the lateral walls of the blades present in this embodiment. The lower pressures over the centralizer due to the bigger erodible area make this centralizer more efficient in terms of life period (decreased rod guide life due to erosion).

In summary, the design of the rod guide 26 and 126 of the present disclosure has at least the following advantages:

1) Reduction of pumping force (contrary to the direction of motion of the string) due to decreasing the drag coefficient (Cd) of the body.

The geometries of many prior art rod guides have angles of approximately 30° in the flow edges on each side. Drag coefficients of bodies immersed in fluids that are a triangular solid of revolution of 60° have a Cd of 1.4 approx. In a triangular solids of revolution of 30°, Cd decreases to 1.0. The design of rod guides 26 and 126 of the present disclosure have lower incidence angles of approx. 15° per side. This design geometry results in an improved drag coefficient of Cd<1. This improvement in drag coefficient Cd translates into a reduction of approximately 40% on the pumping force that is generated by the obstruction to the passage of fluid around each rod guide 26, 126, greatly increasing the overall efficiency of the production system because the angle of the surface 34 and 134 is about 15 degrees.

2) Stable boundary layer

The geometry of the flow channels in the rod guides 26 and 126 favors an increase in speed in the fluid flowing around the body 28, 128 (increasing velocity gradient). Therefore, the boundary layer remains in contact with the body 28, 128 of the guide 26, 126, and thus preventing detachment of flow and pressure losses.

3) Effect of particles sweep and scale

As discussed in point 2), the geometry of the flow channels generates, in the first half, an increasing velocity gradient that favors the sweep of particles preventing scale formation on the surface of the rod guide.

4) Increased external surface area for longer wearing surface against the tubing wall In this embodiment, due to the fact that blades 30, 130 are wider in the middle section than prior art blades, the contact area or erodible area of the rod guide is larger.

A number of implementations have been described. Nevertheless, it will be understood that various modifications may be made. Accordingly other implementations are within the scope of the following claims:

What is claimed is:

1. A polymeric rod guide for a sucker rod, said polymeric rod guide comprising:

a body surrounding and coaxial with the sucker rod, said body having a polygonal cross-section molded in fixed contact with the sucker rod; and a plurality of blades longitudinally disposed and extending from the body, each blade having a pair of longitudinal side walls with at least one planar surface and an exterior longitudinal edge, each of said blades having a first blade face disposed between a first terminal end of the blade and the exterior longitudinal edge and a second blade face disposed between a second terminal end of the blade and the exterior longitudinal edge, and an area of the body between the longitudinal side wall of a first blade and the longitudinal side wall of an adjacent second blade defines a trough having a plurality of planar surfaces.

2. The rod guide of claim 1 wherein the rod guide further includes a first curved lead section molded integral with the body, said lead section disposed longitudinally about the rod and terminating at a first end on an outer surface of the rod and disposed at a second end in integral contact with the body, said lead section having a curved surface with a radius of curvature of in a range of 20 to 22 mm.

3. The rod guide of claim 1 wherein the rod guide further includes a first curved lead section molded integral with the body, said lead section having an outer curved surface that extends from the rod to the body, said curved surface defined by a tangent to the mid-point of the curved surface having an angle of between 5 and 20 degrees measured between a line parallel to a longitudinal axis of the rod and the tangent to the curved surface of the lead section.

4. The rod guide of claim 1 wherein the plurality of blades includes 4 blades circumferentially disposed 90 degrees about the body of the rod guide.

5. The rod guide of claim 1 wherein the exterior longitudinal edge has a convex curved surface with a radius of curvature being a same radius of curvature as an inner surface of a tube into which the rod and rod guide is to be used.

6. The rod guide of claim 1 wherein the trough between the longitudinal side walls includes:

a first planar surface that tapers away from the first terminal end of the blade face at a first angle (a1) measured between a line parallel to a longitudinal axis of the rod and the first planar surface, a second planar surface disposed adjacent to the first planar surface, and a third planar surface disposed adjacent to the second planar surface, said third planar surface away from the second terminal end of the blade face at a second angle (c1) measured between a line parallel to the longitudinal axis of the rod and the third planar surface.

7. The rod guide of claim 6 wherein the first angle (a1) is less than or equal to 15 degrees, the second planar surface is generally parallel to the axis of the rod, and the second angle (c1) is less than or equal to 15 degrees.

8. The rod guide of claim 6 wherein the first angle (a1) is less than or equal to 4 degrees, the second planar surface is generally parallel to the axis of the rod, and the second angle (c1) is less than or equal to 4 degrees.

9. The rod guide of claim 6 wherein the second planar surface has a first predetermined longitudinal length (Lb) parallel to the axis of the rod, the first planar surface and the third planar surface each have a longitudinal length (La, Lc) greater than the longitudinal length (Lb) of the second planar surface.

10. The rod guide of claim 9 wherein the longitudinal length of the first planar surface and third planar surface is in a range of 55 to 75 mm and the second planar surface has a longitudinal length of in a range of 0 to 30 mm.

11. The rod guide of claim 9 wherein the longitudinal length (Lb) of the second planar surface is at least twice a width of the second planar surface.

12. The rod guide of claim 1 wherein the blade face comprises a curved surface that extends from the first terminal end of the blade to the exterior longitudinal edge, said curved surface defined by a tangent to a mid-point of the curved surface having an angle of in a range of 10 to 40 degrees measured between a line parallel to a longitudinal axis of the rod and the tangent to the curved surface of the blade face.

13. The rod guide of claim 1 wherein the blade face comprises a curved surface that extends from the first terminal end to the exterior longitudinal edge, said curved surface having a radius of curvature of in a range of 20 to 22 mm.

14. A polymeric rod guide for a sucker rod, said polymeric rod guide comprising:

a body surrounding and coaxial with the sucker rod, said body having a polygonal cross-section molded in fixed contact with the sucker rod; and a plurality of blades longitudinally disposed and extending from the body;

each blade having a pair of longitudinal side walls, each of said longitudinal side walls having a first planar surface that tapers away from a first terminal end of the blade at a first angle (a') measured between a line parallel to a longitudinal axis of the rod and the first planar surface, at least a second planar surface disposed intermediate to the first planar surface, and a third planar surface that tapers away from second terminal end of the blade at a second angle (c') measured between a line parallel to the longitudinal axis of the rod and the third planar surface, each blade having an exterior longitudinal edge, each of said blades having a first blade face disposed between a first terminal end of the blade and the exterior longitudinal edge, and a second blade face disposed between a second terminal end of the blade and the exterior longitudinal edge, and an area of the body between the longitudinal side wall of a first blade and the longitudinal side wall of an adjacent second blade defines a trough having a plurality of planar surfaces.

15. The rod guide of claim 14 wherein the first angle (a') is less than or equal to 15 degrees, the second planar surface is generally perpendicular to the axis of the rod, and the second angle (c') is less than or equal to 15 degrees.

16. The rod guide of claim 14 wherein the first angle (a') is less than or equal to 4 degrees, the second planar surface is generally perpendicular to the axis of the rod, and the second angle (c') is less than or equal to 4 degrees.

17. The rod guide of claim 14 wherein the second planar surface has a first predetermined longitudinal length (Lb') parallel to the axis of the rod, the first planar surface and the third planar surface each have a longitudinal length (La', Lc') greater than the longitudinal length (Lb') of the second planar surface.

18. The rod guide of claim 17 wherein the longitudinal length of the first planar surface and third planar surface is in a range of 55 to 75 mm and the second planar surface has a longitudinal length of in a range of 0 to 30 mm.

19. The rod guide of claim 17 wherein the longitudinal length (Lb') of the second planar surface is at least twice a width of the second planar surface.

20. The rod guide of claim 14 wherein the rod guide further includes first curved lead section molded integral with the body, said lead section disposed longitudinally about the rod and terminating at a first end on an outer surface of the rod and disposed at a second end in integral contact with the body, said lead section having a curved surface with a radius of curvature of in a range of 20 to 22 mm.

21. The rod guide of claim 20 wherein the rod guide further includes a first curved lead section molded integral with the body, said lead section having outer curved surface that extends from the rod to the body, said curved surface defined by a tangent to the mid-point of the curved surface having an angle of in a range of 5 to 20 degrees measured between a line parallel to the longitudinal axis of the rod and the tangent to the curved surface of the lead section, said curved surface having a radius of curvature of in a range of 20 and 22 mm.

22. The rod guide of claim 14 wherein the exterior longitudinal edge has a convex curved surface with a radius of curvature being a same radius of curvature as an inner surface of a tube into which the rod and rod guide is to be used.

23. The rod guide of claim 14 wherein the trough between the longitudinal side walls includes:

a first planar surface that tapers away from the first terminal end of the blade face at a third angle (a1) measured between a line parallel to the longitudinal axis of the rod and the first planar surface, a second planar surface disposed adjacent to the first planar surface, and a third planar surface disposed adjacent to the second planar surface, said third planar surface tapers away from the second terminal end of the blade face at a fourth angle (c1) measured between a line parallel to the longitudinal axis of the rod and the third planar surface.

24. The rod guide of claim 23 wherein the third angle (a1) is less than or equal to 4 degrees, the second planar surface is generally parallel to the axis of the rod, and the fourth angle (c1) is less than or equal to 4 degrees.

25. The rod guide of claim 23 wherein the blade face comprises a curved surface that extends from the first terminal end of the blade to the exterior longitudinal edge, said curved surface defined by a tangent to a mid-point of the curved surface having an angle of in a range of 10 to 40 degrees measured between a line parallel to the longitudinal axis of the rod and the tangent to the curved surface of the blade face.

26. The rod guide of claim 23 wherein the second planar surface has a first predetermined longitudinal length (Lb) parallel to the axis of the rod, the first planar surface and the third planar surface each have a longitudinal length (La, Lc) greater than the longitudinal length (Lb) of the second planar surface.

27. The rod guide of claim 23 wherein a longitudinal length of the first planar surface and third planar surface is in a range of 55 to 75 mm and the second planar surface has a longitudinal length of in a range of 0 to 30 mm.

28. The rod guide of claim 23 wherein a longitudinal length (Lb) of the second planar surface is at least twice a width of the second planar surface.

29. The rod guide of claim 14 wherein the blade face comprises a curved surface that extends from the first terminal end to the exterior longitudinal edge.

30. The rod guide of claim 14 wherein the second planar surface is disposed adjacent to the first planar surface, and a third planar surface is disposed adjacent to the second planar surface.

31. A method of installing a rod guide on a sucker rod comprising: molding a unitary rod guide coaxial about and in fixed contact with the sucker rod, said guide comprising a body portion surrounding and coaxial with the sucker rod, said body having a plurality of blades longitudinally disposed and extending from the body, each blade having a pair of longitudinal side walls with at least one planar surface and an exterior longitudinal edge, each of said blades having a first blade face disposed between a first terminal end of the blade and the exterior longitudinal edge and a second blade face disposed between a second terminal end of the blade and the exterior longitudinal edge, and an area of the body between the longitudinal side wall of a first blade and the longitudinal side wall of an adjacent second blade defines a trough having a plurality of planar surfaces.

32. The method of claim 31 further including concurrently molding a first lead section integral with the body, said lead section disposed longitudinally about the rod and terminating at a first end on an outer surface of the rod and disposed at a second end in contact with the body, said lead section having a curved surface with a radius of curvature of in a range of 20 to 22 mm and said curved surface further defined by a tangent to the mid-point of the curved surface having an angle in the range of 5 to 20 degrees measured between a line parallel to the longitudinal axis of the rod and the tangent to the curved surface of the lead section.

33. The method of claim 31 wherein the trough between the longitudinal side walls includes:

a first planar surface that tapers away from the first terminal end of the blade face at a first angle (a1) measured between a line parallel to a longitudinal axis of the rod and the first planar surface, a second planar surface disposed adjacent to the first planar surface, and a third planar surface disposed adjacent to the second planar surface, said third planar surface tapering away from the second terminal end of the blade face at a second angle (c1) measured between a line parallel to the longitudinal axis of the rod and the third planar surface.

34. The method of claim 31 further including;

preparing a section of the rod by placing an epoxy based glue on a predetermined portion of the rod and placing particles having a diameter in a range of 0.71 to 1.18 mm onto the epoxy glue; and direct injection molding the rod guide about at least a portion of the prepared section of the rod.

35. The rod guide of claim 31 wherein each of the longitudinal side walls of the blade is a single planar surface.

36. The rod guide of claim 31 wherein the trough includes a plurality of planar surfaces.

37. A method of installing a rod guide on a sucker rod comprising: molding a unitary rod guide coaxial about and in fixed contact with the sucker rod, said guide comprising a body portion surrounding and coaxial with the sucker rod, said body having a plurality of blades longitudinally disposed and extending from the body, each blade having a pair of longitudinal side walls, each of said longitudinal side walls have a first planar surface that tapers away from a first terminal end of the blade at a first angle (a') measured between a line parallel to a longitudinal axis of the rod and the first planar surface, at least a second planar surface disposed intermediate to the first planar surface, and a third planar surface that tapers away from a second terminal end of the blade at a second angle (c') measured between a line parallel to the longitudinal axis of the rod and the third planar surface, each blade having an exterior longitudinal edge, each of said blades having a first blade face disposed between a first terminal end of the blade and the exterior longitudinal edge, and a second blade face disposed between a second terminal end of the blade and the exterior longitudinal edge, and an area of the body between the longitudinal side wall of a first blade and the longitudinal side wall of an adjacent second blade defines a trough having a plurality of planar surfaces.

38. The method of claim 37 further including concurrently molding a first curved lead section integral with the body, said lead section disposed longitudinally about the rod and terminating at a first end on an outer surface of the rod and disposed at a second end in contact with the body, said lead section having a curved surface with a radius of curvature in the range of 20 to 22 mm and said curved surface further defined by a tangent to the mid-point of the curved surface having an angle of in a range of 5 to 20 degrees measured between a line parallel to the longitudinal axis of the rod and the tangent to the curved surface of the lead section.

39. The method of claim 37 wherein the trough between the longitudinal side walls includes:

a first planar surface that tapers away from the first terminal end of the blade face at a third angle (a1) measured between a line parallel to the longitudinal axis of the rod and the first planar surface, a second planar surface disposed adjacent to the first planar surface, and a third planar surface disposed adjacent to the second planar surface, said third planar surface tapers away from the second terminal end of the blade face at a fourth angle (c1) measured between a line parallel to the longitudinal axis of the rod and the third planar surface.

40. The method of claim 37 further including:

preparing a section of the rod by placing an epoxy based glue on a predetermined portion of the rod and placing particles having a diameter in the range of 0.71 to 1.18 mm onto the epoxy glue; and direct injection molding the rod guide about at least a portion of the prepared section of the rod.

41. A polymeric rod guide for a sucker rod, said polymeric rod guide comprising:

a body surrounding and coaxial with the sucker rod, said body having a polygonal cross-section molded in fixed contact with the sucker rod; and a plurality of blades longitudinally disposed and extending from the body, each blade having a pair of longitudinal side walls having a plurality of planar surfaces and an exterior longitudinal edge, each of said blades having a first blade face disposed between a first terminal end of the blade and the exterior longitudinal edge and a second blade face disposed between a second terminal end of the blade and the exterior longitudinal edge, and an area of the body between the longitudinal side wall of a first blade and the longitudinal side wall of an adjacent second blade defines a trough having at least one planar surface.

42. A method of installing a rod guide on a sucker rod comprising: molding a unitary rod guide coaxial about and in fixed contact with the sucker rod, said guide comprising a body portion surrounding and coaxial with the sucker rod, said body having a plurality of blades longitudinally disposed and extending from the body, each blade having a pair of longitudinal side walls with a plurality of planar surfaces and an exterior longitudinal edge, each of said blades having a first blade face disposed between a first terminal end of the blade and the exterior longitudinal edge and a second blade face disposed between a second terminal end of the blade and the exterior longitudinal edge, and an area of the body between the longitudinal side wall of a first blade and the longitudinal side wall of an adjacent second blade defines a trough having a plurality of planar surfaces.

* * * * *